United States Patent [19]

Månsson

[11] Patent Number: 4,589,481

[45] Date of Patent: May 20, 1986

[54] TUBE HEAT EXCHANGER

[75] Inventor: Rune Månsson, Uttran, Sweden

[73] Assignee: AB Zander & Ingestrom, Stockholm, Sweden

[21] Appl. No.: 598,310

[22] PCT Filed: Jun. 27, 1983

[86] PCT No.: PCT/SE83/00262

§ 371 Date: Feb. 29, 1984

§ 102(e) Date: Feb. 29, 1984

[87] PCT Pub. No.: WO84/00207

PCT Pub. Date: Jan. 19, 1984

[30] Foreign Application Priority Data

Jun. 29, 1982 [SE] Sweden ..... 8204017

[51] Int. Cl.[4] ..... F28F 1/06

[52] U.S. Cl. ..... 165/172; 165/162; 165/910

[58] Field of Search ..... 165/DIG. 13, 172, 162, 165/178, 910

[56] References Cited

U.S. PATENT DOCUMENTS

| | | | |
|---|---|---|---|
| 612,175 | 10/1898 | Phelps, Jr. | 165/172 |
| 1,852,489 | 4/1932 | Sullivan | 165/156 |
| 2,021,117 | 11/1935 | Lucke | 165/151 X |
| 2,230,221 | 2/1941 | Fitch | 165/172 |
| 3,897,821 | 8/1975 | Babunovic et al. | 165/178 X |
| 4,206,806 | 6/1980 | Togashi | 165/DIG. 13 |
| 4,245,697 | 1/1981 | Togashi | 165/179 |
| 4,393,926 | 7/1983 | Appel | 165/172 X |

FOREIGN PATENT DOCUMENTS

| | | | |
|---|---|---|---|
| 795693 | 5/1958 | United Kingdom | 165/109.1 |
| 840662 | 8/1979 | U.S.S.R. | 165/172 |

*Primary Examiner*—Sheldon J. Richter

*Attorney, Agent, or Firm*—Cyrus S. Hapgood

[57] ABSTRACT

In a tube heat exchanger, each tube in a set has a non-round cross-section and two or more ridges extending helically around the tube's center line for keeping the center lines of the tubes at defined distances from each other, some of the tubes (14) being arranged so that the distance between the center lines of two adjacent tubes is essentially the same as or less than the sum of the radii of the circles circumscribing these tubes. Flattened cross-sections of the tubes may form a pattern of squares; or the center lines of the tubes may form a dividing pattern in the form of equilateral triangles, two adjacent tubes resting against each other at supporting points where the flattened cross-section of one tube forms a right angle with the flattened cross-section of the adjacent tube on the same level.

2 Claims, 22 Drawing Figures

TUBE HEAT EXCHANGER

Figure 1:
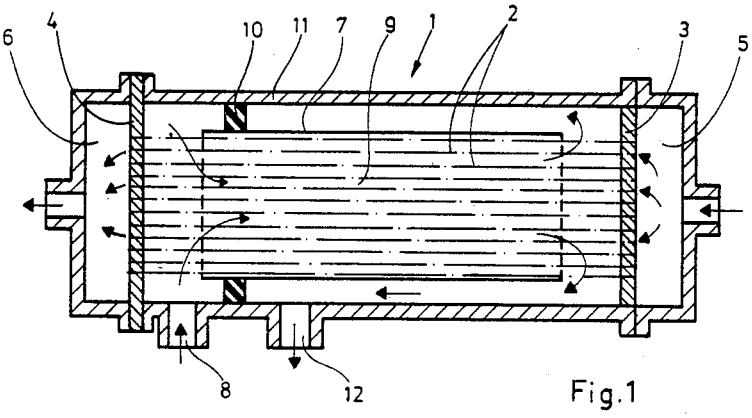

This invention relates to a heat exchanger comprising a set of tubes having essentially straight and parallel centre lines arranged in defined distances from each other, an inlet chamber for supplying a first medium to the tubes through a first wall that keeps the tubes together at the one end of the set of tubes, an outlet chamber for conveying away the medium from the tubes through a second wall that keeps the tubes together at the other end of the set of tubes, and a space between the tubes that at the ends of the tubes is delimited by mentioned walls for through-flow of a second medium, respective tube 14 along the main part of its length between the walls having a non-round cross-section form with two or more ridges 15, which extend helically round the centre line of the tube, and the tubes by their ridges 15 keeping each other on the defined distances from each other.

Such a heat exchanger is known by Russian Pat. No. 761.820. Thus, this publication discloses helical tubes resting against each other. In this connection the tubes touch each other with the tops of the ridges. This leads to that the space between the tubes becomes unnecessarily large for certain applications and that the heat exchanger does not get the desired, compact form.

These disadvantages are removed by the present invention that is characterized in that the tubes are so arranged in the heat exchanger that the distance between the centre lines of two adjacent tubes is less than the sum of the radii of the circles that circumscribe the two tubes.

Since the inside as well as the outside of the tubes have helical form the turbulence and due to that the heat transfer between the media will be essentially improved, whereby the heat transferring surfaces and thereby the heat exchanger can be made essentially smaller. Moreover, the tubes can be twisted in relation to each other in different ways such that the distances between the centre lines of the tubes will be different, whereby the size of the passages between the tubes can be made different such that the heat transfer in the passages between the tubes can be influenced. The tubes will support against each other in along the tubes regularly recurrent supporting points and the tubes are steadily kept together by one or several bands or similar things, which are tightened round the set of tubes. Since the helical tubes have the same cross-section form the pressure drop over and by that the flow through the tubes are the same. The tubes are easily rolled to a helical form from circular-cylindrical tubes, for instance by such a rolling machine disclosed in the Finnish Pat. No. 54.064.

According to a further development of the invention applied to a flattened tube form having two tops the ridges extend helically round the centre line of respective tube in the same direction on all of the tubes. In this connection the centre lines of the tubes are arranged with a dividing pattern in the form of squares and the tubes are so twisted in relation to each other that they touch each other with their ridges in cross-section planes through the set of tubes, where the flattened cross-section forms of the tubes form a pattern in the form of squares, the flattened cross-section forms touching each other at the ends and constitute sides of the squares.

According to a further development of the invention applied to the flattened tube form having two tops the passages between the tubes can be made still more narrow by arranging the centre lines of the tubes on several parallel levels above each other and in the same distance from each other, the centre lines on one level being laterally displaced in relation to the centre lines on a subjacent level such that the centre lines form a dividing pattern in the form of equilateral triangles that on each level the ridges of one tube extend helically round the centre line of the tube in one direction and the ridges of an adjacent tube extend helically round its centre line in the other direction and that the tubes are so twisted in relation to each other that there are cross-sections through the set of tubes where the flattened cross-section form of a tube forms a right angle with the flattened cross-section form of an adjacent tube on the same level.

According to a further development of the invention the pitch of the helical ridges of the tubes is the same for all tubes of the set of tubes along the whole length of the set of tubes.

Due to the fact the simpliest type of tubes is received which is easiest to produce and which is best fitted for other tubes in the set of tubes.

Figure 2:
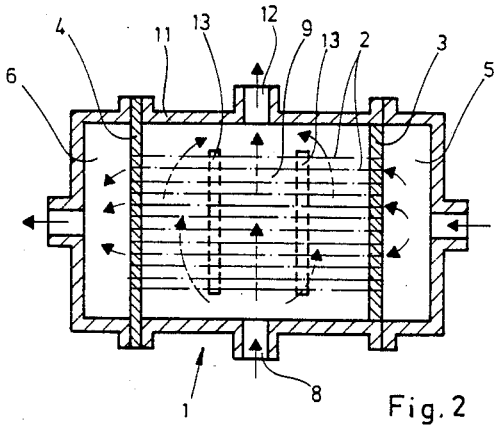
Figure 8:
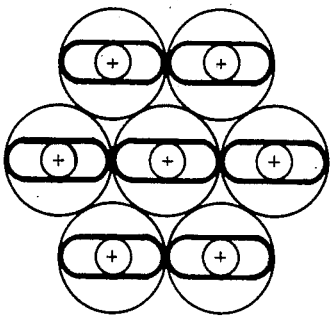
Figure 9:
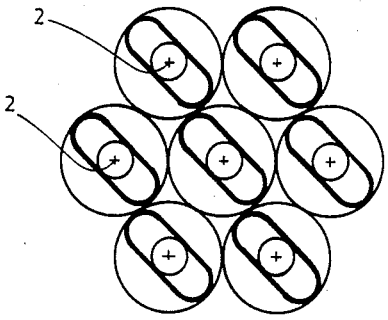
Figure 3:
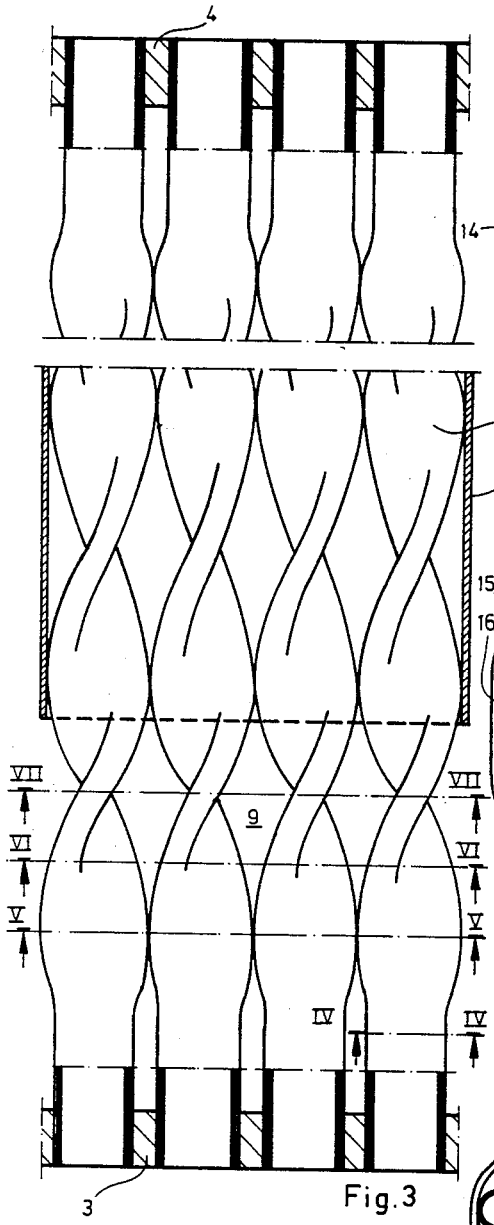
Figure 4:
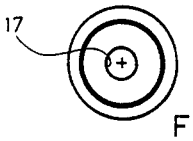
Figure 7:
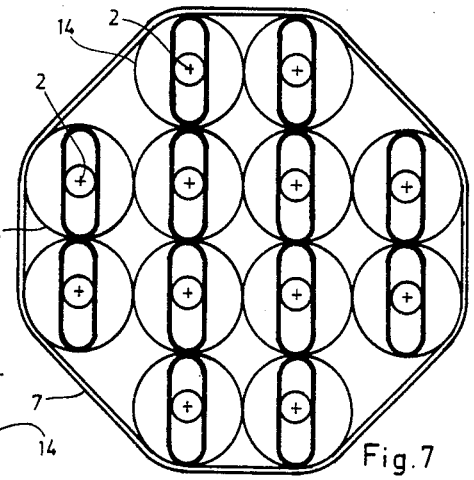
Figure 6:
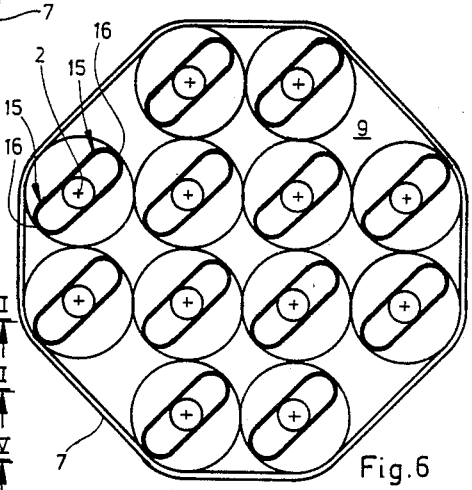
Figure 5:
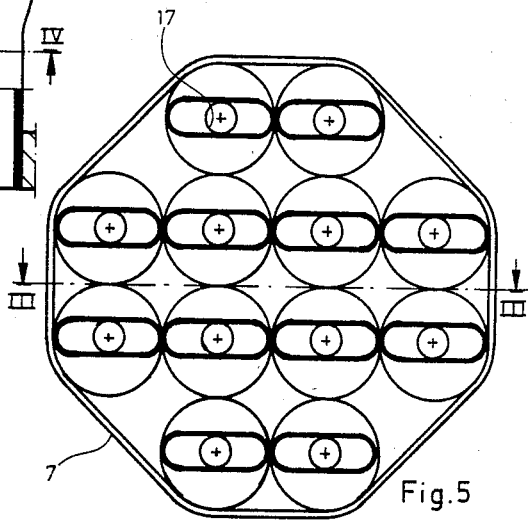
Figure 13:
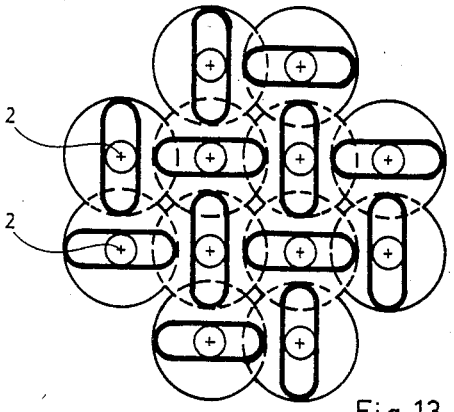
Figure 12:
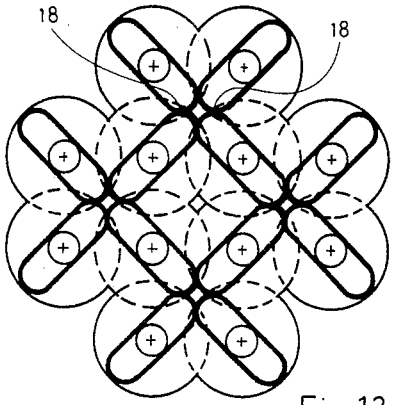
Figure 11:
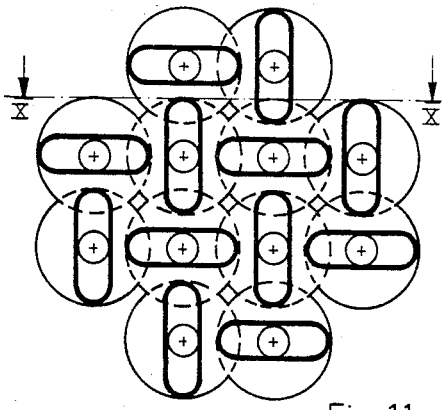
Figure 10:
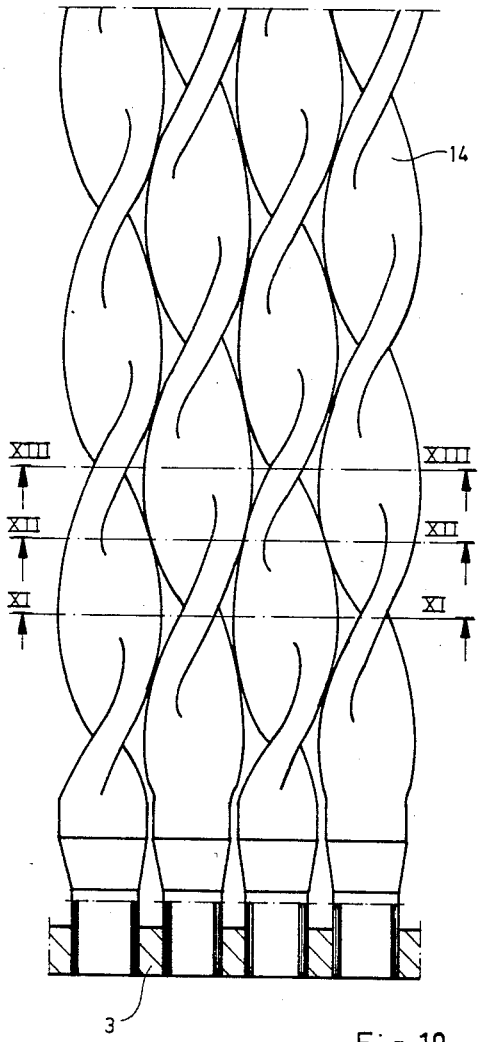
Figure 18:
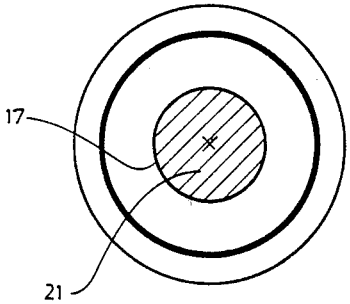
Figure 17:
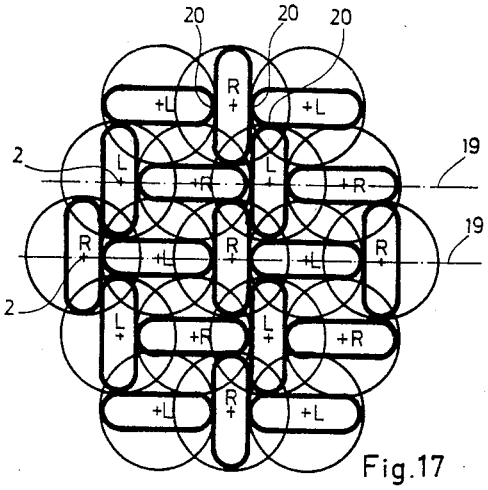
Figure 14:
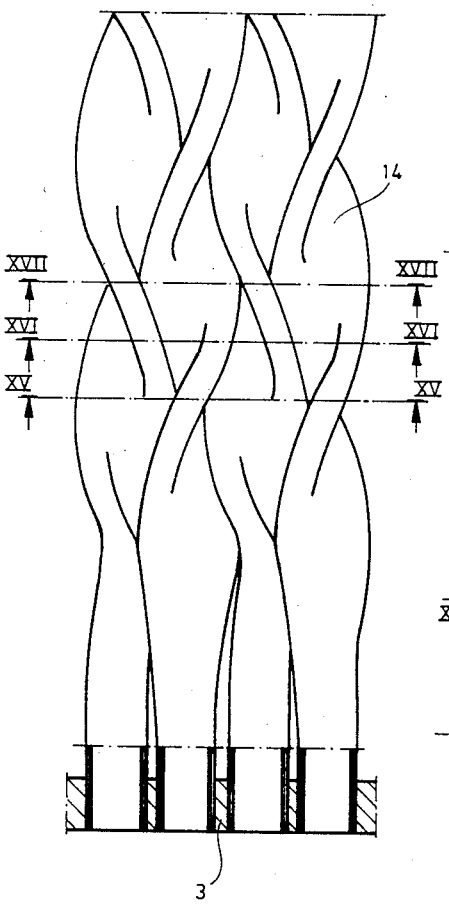
Figure 16:
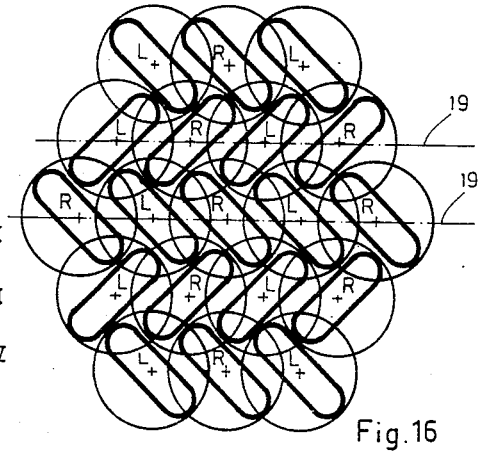
Figure 15:
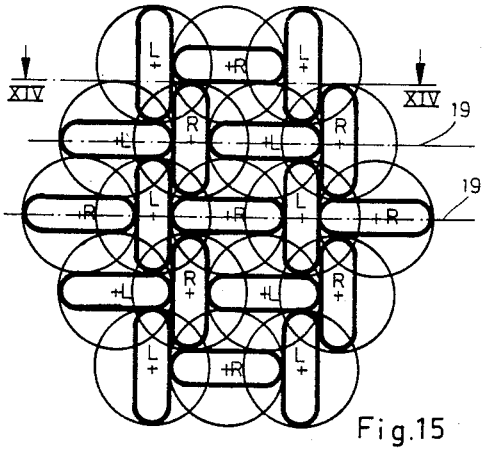
Figure 19:
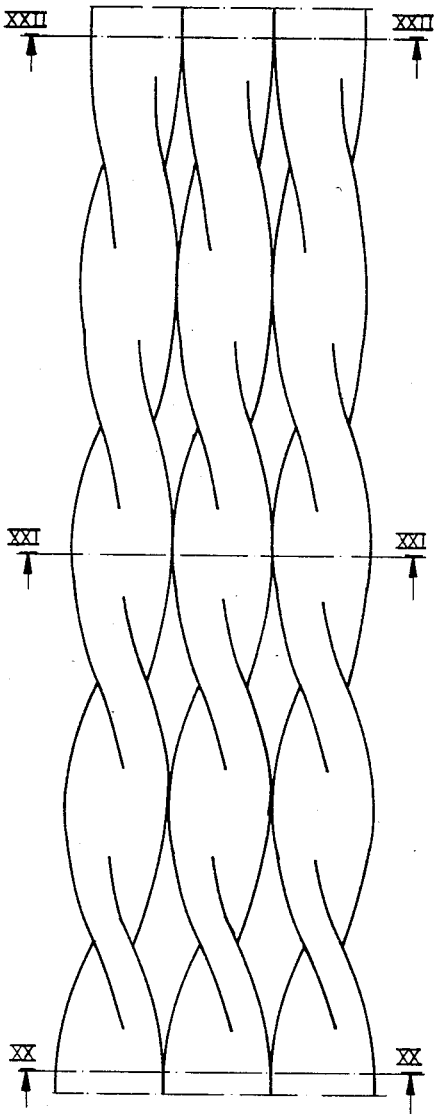
Figure 22:
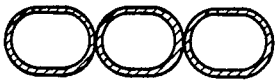
Figure 21:
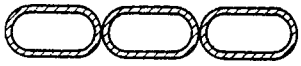
Figure 20:
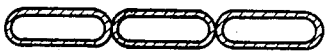

Embodiments of different tube heat exchangers according to the invention and different arrangements of the tubes in these ones are disclosed on the accompanying drawings, in which FIG. 1 is a longitudinal section of a tube heat exchanger, in which a set of tubes is indicated by the centre lines of the tubes and the heat exchanging media flow parallel with each other through the set of tubes, FIG. 2 is another heat exchanger in which the heat exchanging media flow across each other through the set of tubes, FIG. 3 is a longitudinal section of a set of tubes according to the indication III—III of FIG. 5, where it is evident that the tubes have a helical form, FIG. 4 is a cross-section of an end part of a tube according to the indication IV—IV of FIG. 3, FIGS. 5–7 are different cross-sections of the set of tubes according to the indications V—V, VI—VI and VII—VII, respectively, of FIG. 3, FIGS. 8 and 9 are different cross-sections of a set of tubes with another dividing pattern but with the same individual tubes as in FIG. 3, FIG. 10 is a longitudinal section according to the indication X—X of FIG. 11 of a further type of set of tubes in which the tubes are arranged in thread engagement beside each other, FIGS. 11–13 are different cross-sections of the set of tubes according to the indications XI—XI, XII—XII and XIII—XIII, respectively, of FIG. 10, FIG. 14 is a longitudinal section according to the indication XIV—XIV of FIG. 15 of another type of set of tubes, in which the tubes are twisted to the right as well as to the left, FIGS. 15–17 are different cross-sections of the set of tubes according to the indications XV—XV, XVI—XVI and XVII—XVII, respectively, FIG. 18 is a section of the end part of a tube, FIG. 19 is a longitudinal section of a part of a set of tubes, and FIG. 20–22 are different cross-sections of the set of tubes according to the indications XX—XX, XXI—XXI and XXII—XXII, respectively.

With reference to FIG. 1 a heat exchanger is indicated by 1 and comprises a set of tubes having essentially straight and parallel centre lines 2, which tubes at their ends are fastened to walls 3 and 4. A first medium is via an inlet chamber 5 and the wall 3 taken into the set of tubes, wherefrom the medium leaves through the wall 4 and an outlet chamber 6.

The tubes of the set of tubes are kept together between the walls 3 and 4 by a cover 7, which is tightened round the set of tubes. A second medium is taken through an inlet 8 into the passages 9 between the tubes and flows therefrom, guided by a wall 10 between the cover 7 and the case 11 of the heat exchanger, through one end of the cover 7 parallel with the tubes to the second end of the cover, wherefrom the medium flows to an outlet 12. In this connection the media exchange heat with each other through the tube walls.

The heat exchanger in FIG. 2 distinguishes from the heat exchanger in FIG. 1 in that respect that the second medium flows through the passages 9 between the tubes mainly in cross direction to the medium in the tubes, the cover 7 being replaced by narrow bands 13 allowing such cross-flow through the set of tubes. Otherwise the heat exchangers in FIGS. 1 and 2 are principally the same and elements having the same function have been denoted by the same numbers in FIGS. 1 and 2.

Respective tube in the set of tubes has a helical form which in the examples of FIG. 3–17 has been received by flattening a circular-cylindrical tube 14 to helical form such that it has received a flattened cross-section form with two reverse-directed ridges 25, each of which having a top 16, which tops are in the same radial distance from the centre line 2 of the tube and in the distance of 180 angular degrees from each other round the centre line 2.

The tube can for instance be formed of a circular-cylindrical tube having the outer diameter 14 mm and the wall thickness 1 mm which tubes have been flattened to helical form with the constant pitch of 90 mm along the whole length of the helical part and such that the length of the tube cross-section, i.e. the distance between the tops, becomes 18 mm and the width thereof 6 mm.

In FIGS. 3–7 the tubes are arranged in a square dividing pattern, i.e. in a cross-section through the set of tubes the centre points of four adjacent tubes form the corners of a square. The tubes are so twisted in relation to each other that they touch each other in the tops such that the tubes will support against each other at regular intervals along the length of the set of tubes.

In FIG. 5 there is shown a cross-section according to the indication V—V of FIG. 3 where the tubes support against each other with their tops. Above the plane V—V of FIG. 3 there will be no contact between the tubes. In the plane VI—VI, see FIG. 6 the cross-section forms of the tubes have turned 45° and the passages 9 between the tubes are here open for in-flow of medium from the outside of the set of tubes. In the plane VII—VII, see FIG. 7, the tubes will again support against each other.

Thus, the tubes will support against each other at regular intervals that are equal to the distance between the planes V—V and VII—VII and are steadily kept together by the cover 7 such that the tubes cannot move relative to each other and wear against each other.

The ends of the tubes have retained the original circular-cylindrical form of the tubes, see FIG. 4 and find room beside each other in holes that have been made in the walls 3 and 4, to which the ends of the tubes can be welded, for instance. The small circle 17 that is located inside the flattened cross-section of the tubes represents the outline of the hole that can be seen through the tubes.

In FIGS. 8 and 9 the tubes are arranged in a dividing pattern in the form of equilateral triangles, i.e. in a cross-section through the set of tubes the centre points of three adjacent tubes form the corners of an equilateral triangle. The tubes that all are twisted in the same direction are twisted so in relation to each other that they touch each other in the tops and will in the same way as the tubes in the FIGS. 3–7 support against each other at regular intervals along the length of the set of tubes. In this case the supporting points return after a turning of 60 angular degrees of the tube cross-section. In FIG. 9 there is shown a cross-section in which the tube cross-section has turned itself 45 angular degrees in relation to the cross-section in FIG. 8.

In the embodiments according to FIGS. 3–9 the distance between the centre lines of two adjacent tubes is essentially the same as the sum of the radii of the circles that circumscribe these tubes.

In the embodiment according to FIGS. 10–13 the tubes are in thread engagement with each other and arranged in a square dividing pattern with a distance between the centre lines of two adjacent tubes that is less than in FIGS. 3–7. This distance $A_1$, in the embodiment according to FIGS. 10–13 is less than the sum of the radii of the circles that circumscribe these two adjacent tubes.

The tubes that all are twisted in the same direction are twisted so in relation to each other that the tubes touch each other with their ridges, see FIG. 12, in cross-section planes through the set of tubes in which the flattened cross-section forms of the tubes form a pattern in the form of squares. The supporting points 18 between the tubes return along the set of tubes after a turning of 90 angular degrees of the tube cross-section.

In order to give room for the circular-cylindrical ends of the tubes in holes of the wall 3 the diameter of the tube ends has been reduced to a suitable measure by plastic machining. The described embodiment according to FIGS. 10–13 is extremely compact and solid. The device brings about that the possibility to vary the through-flow area in relation to the heating area becomes greater, which means that an optimum heat transfer is received within a large application field.

In the embodiment according to the FIGS. 14–17 the tubes are also in thread engagement with each other and arranged in a dividing pattern in the form of equilateral triangles with a distance $A_2$ between the centre lines of two adjacent tubes that is less than the distance between the centre lines of corresponding tubes in the embodiment according to FIGS. 8 and 9. This distance $A_2$ is essentially less than the sum of the radii of the circles that circumscribe the two adjacent tubes.

The tubes that on each level 19 are alternately formed with right screw, tubes indicated by R, and with left screw, tubes indicated by L, are arranged so in relation to each other that at such cross section through the set of tubes in which the flattened cross-section form of a tube forms a right angle with the flattened cross-section form of an adjacent tube on the same level 19 (see FIGS. 15 and 17), there these two adjacent tubes rest against each other at supporting points 20. These supporting points 20 between the tubes return along the set of tubes after a turning of 90 angular degrees of the tube cross-section.

Due to the fact that tubes formed alternately with right- and leftscrew cooperate with each other and are arranged in the described way an extremely compact and solid heat exchanger is received, in which the distance $A_2$ between the centre lines of two adjacent tubes is less than the corresponding distance $A_1$ in the embodiment according to the FIGS. 10–13. That means that the advantages stated for the last-mentioned embodiment have been further accentuated in the embodiment according to the FIGS. 14–17.

In order to give room for the circular-cylindrical ends in holes of the wall 3 the diameter of the tube ends has been reduced to a suitable measure by plastic machining.

The passages 9 between the tubes disclosed in the FIGS. 3–17 have a defined but irregular form that promotes turbulence and thus heat transfer, which defined irregular form returns at regular intervals for a medium flowing in the passages 9 parallel with or cross to the tubes. Due to that the resistance against flow through the passages 9 will be evenly distributed over the flow cross-section at parallel flow as well as cross-flow relative to the tubes, whereby the thermal load in the passages will be evenly distributed over the whole set of tubes. Thus the sets of tubes according to the FIGS. 3–17 can be used in that type of heat exchanger disclosed in FIG. 1 as well as in that type disclosed in FIG. 2.

If the tubes are designed with a pitch that is changed in the longitudinal direction of the set of tubes the resistance against flow through the passages parallel with the tubes will be evenly distributed over the set of tubes, since each cross-section through the set of tubes will present a number of passages with a similar cross-section form, and, therefore, such a design of the tubes can also be used for the heat exchanger according to FIG. 1.

The tube cross-section, of course, can be provided with three or more ridges if that turns out to be suitable.

Moreover, in the set of tubes according to the FIGS. 3–7, for instance, every second tube can be given twice as big pitch as the remaining tubes, whereby a further form of the passages 9 is received.

The invention also comprises a tube heat exchanger consisting of a combination of one or both of the embodiments according to the FIGS. 3–9 and one or both of the embodiments according to the FIGS. 10–17. That means that the set of tubes will contain tubes arranged in that way that adjacent tubes will rest against each other, the distance between the centre lines of two adjacent tubes partly being essentially the same as, and partly, less than the sum of the radii of the circles that circumscribe these tubes.

In FIG. 18 that is a cross-section through the end part of a tube similar to that disclosed in FIG. 4 a further development of the invention is disclosed. This further development comprises that the hole delimited by the circle 17 has been provided with a core 21. This core comprises a wire or a bar introduced into the tube. Due to that is achieved partly that the tube becomes stronger and more solid, partly that the through-flow area on the inside of the tube becomes smaller, whereby the velocity of the flow streaming in tube becomes larger. This leads to that the heat transfer between the media on the inside and the outside, respectively, of the tube is improved. It is not necessary that all of the tubes are provided with a core.

In the FIGS. 19–22 there is disclosed a further development of the invention. This further development comprises that the pitch of the helical tube is successively changed along the tube, for instance from one end to the other as disclosed in FIG. 19 such that the through-flow area is continuously changed. Due to that the tube will present different cross-sections at different positions along its length, which is disclosed in the FIGS. 20–22. By this arrangement the tube becomes a cone-formed, which means that if a number of such tubes are put close to each other, the tops of the ridges of one tube resting against the tops of the ridges of an adjacent tube, there is formed a cone-formed package of tubes with continuously changed cross-section area. Due to that fact that advantage is achieved that the one end of the package of tubes takes up a smaller space than the second. Furtheron, by the described arrangement the flowing conditions of the media that are to exchange heat are changed, both the medium flowing on the outside of the tubes and the medium that flows in the tube, which is of great importance in certain applications.

What is claimed is:

1. Heat exchanger comprising a set of tubes having essentially straight and parallel centre lines arranged in defined distances from each other, an inlet chamber for supplying a first medium to the tubes through a first wall that keeps the tubes together at the one end of the set of tubes, an outlet chamber for conveying away the medium from the tubes through a second wall that keeps the tubes together at the other end of the set of tubes, and a space between the tubes that at the ends of the tubes is delimited by mentioned walls for through-flow of a second medium, respective tube along the main part of its length between the walls having a non-round cross-section form with two or more ridges, which extend helically round the centre line of the tube, and the tubes by their ridges keeping each other on the defined distances from each other, characterized in that at least certain of the tubes (14) are applied so in the heat exchanger that the distances ($A_1$,$A_2$) between the centre lines of two adjacent tubes are less than the sum of the radii of the circles that circumscribe the two tubes, each respective tube having a flattened cross-section form with two ridges extending helically round the centre line (2) of the respective tube (14) in the same direction for all tubes, the tubes being so arranged that their centre lines form a dividing pattern in the form of squares, the tubes being so arranged in relation to each other that they touch each other with their ridges (at 18) in cross-section planes through the set of tubes, in which the flattened cross-section forms of the tubes form a pattern in the form of said squares, the flattened cross-section forms touching each other at the ends and constituting sides of the squares.

2. Heat exchanger comprising a set of tubes having essentially straight and parallel centre lines arranged in defined distances from each other, an inlet chamber for supplying a first medium to the tubes through a first wall that keeps the tubes together at the one end of the set of tubes, an outlet chamber for conveying away the medium from the tubes through a second wall that keeps the tubes together at the other end of the set of tubes, and a space between the tubes that at the ends of the tubes is delimited by mentioned walls for through-flow of a second medium, respective tube along the main part of its length between the walls having a non-round cross-section form with two or more ridges, which extend helically round the centre line of the tube, and the tubes by their ridges keeping each other on the defined distances from each other, characterized in that at least certain of the tubes (14) are applied so in the heat exchanger that the distances ($A_1$,$A_2$) between the centre lines of two adjacent tubes are less than the sum of the radii of the circles that circumscribe the two tubes, each respective tube (14) having a flattened cross-section form with two ridges (15), the centre lines (2) of the tubes being arranged on several parallel levels (19) above each other, the ridges of one tube on each level (19) extending helically round the centre line of the tube in the one direction (R) and the ridges of an adjacent tube on said level (19) extending helically round the centre line of the tube in the other direction (L), the tubes (14) being so arranged that their centre lines (2) form a dividing pattern in the form of equilateral triangles, the tubes (14) being arranged in relation to each other so that at such a cross-section through the set of tubes in which the flattened cross-section form of a tube forms a right angle with the flattened cross-section form of an adjacent tube on the same level (19), there these two adjacent tubes rest against each other at supporting points (20).

* * * * *